US008492960B2

(12) United States Patent
Hung et al.

(10) Patent No.: US 8,492,960 B2
(45) Date of Patent: Jul. 23, 2013

(54) LAMP WITH HEAT SINK AND LAMP COVER MOUNTED ON THE HEAT SINK

(75) Inventors: Jui-Wen Hung, Tu-Cheng (TW); Ching-Bai Hwang, Tu-Cheng (TW)

(73) Assignee: Foxconn Technology Co., Ltd., New Taipei (TW)

( * ) Notice: Subject to any disclaimer, the term of this patent is extended or adjusted under 35 U.S.C. 154(b) by 165 days.

(21) Appl. No.: 13/029,129

(22) Filed: Feb. 17, 2011

(65) Prior Publication Data

US 2012/0181913 A1 Jul. 19, 2012

(30) Foreign Application Priority Data

Jan. 14, 2011 (CN) ..... 2011 1 0007615

(51) Int. Cl.
*H01J 61/52* (2006.01)

(52) U.S. Cl.
USPC ..... 313/46; 313/45; 362/249.02

(58) Field of Classification Search
CPC ..... F21V 17/164; F21K 9/135; H01L 23/367; H01L 23/3672
USPC ..... 313/45–46; 362/296; 361/697
See application file for complete search history.

(56) References Cited

U.S. PATENT DOCUMENTS

| | | | | |
|---|---|---|---|---|
| 7,631,987 | B2 * | 12/2009 | Wei | 362/294 |
| 2010/0219735 | A1 * | 9/2010 | Sakai et al. | 313/46 |
| 2010/0289396 | A1 * | 11/2010 | Osawa et al. | 313/46 |
| 2011/0128742 | A9 * | 6/2011 | Yuen et al. | 362/294 |
| 2012/0273180 | A1 * | 11/2012 | Tseng et al. | 165/185 |

* cited by examiner

*Primary Examiner* — Tracie Y Green
(74) *Attorney, Agent, or Firm* — Altis Law Group, Inc.

(57) ABSTRACT

A lamp includes a heat sink and a lamp cover mounted on the heat sink. The lamp cover includes a connecting portion. The heat sink includes a plurality of clamping portions. The plurality of clamping portions surrounds the lamp cover and is spaced apart from each other along a circumferential direction. The plurality of clamping portions each defines a recess facing the lamp cover. The recesses communicate with each other along the circumferential direction whereby an annular engaging groove is defined in the heat sink by the recesses. The connecting portion is engaged in the engaging groove whereby the lamp cover is connected with the heat sink.

14 Claims, 3 Drawing Sheets

LAMP WITH HEAT SINK AND LAMP COVER MOUNTED ON THE HEAT SINK

BACKGROUND

1. Technical Field

The present disclosure relates generally to lamps, and more particularly to a lamp having a lamp cover and a heat sink which can be easily assembled.

2. Description of Related Art

Usually, a lamp has a lamp cover and a heat sink detachably connected with the lamp cover via a plurality of screws. However, the screws must be individually threaded into the lamp cover and the heat sink one by one; thus, assembly of the lamp is inconvenient and time-consuming.

What is needed therefore is a lamp which can overcome the above limitations.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the views.

DETAILED DESCRIPTION

Figure 1:
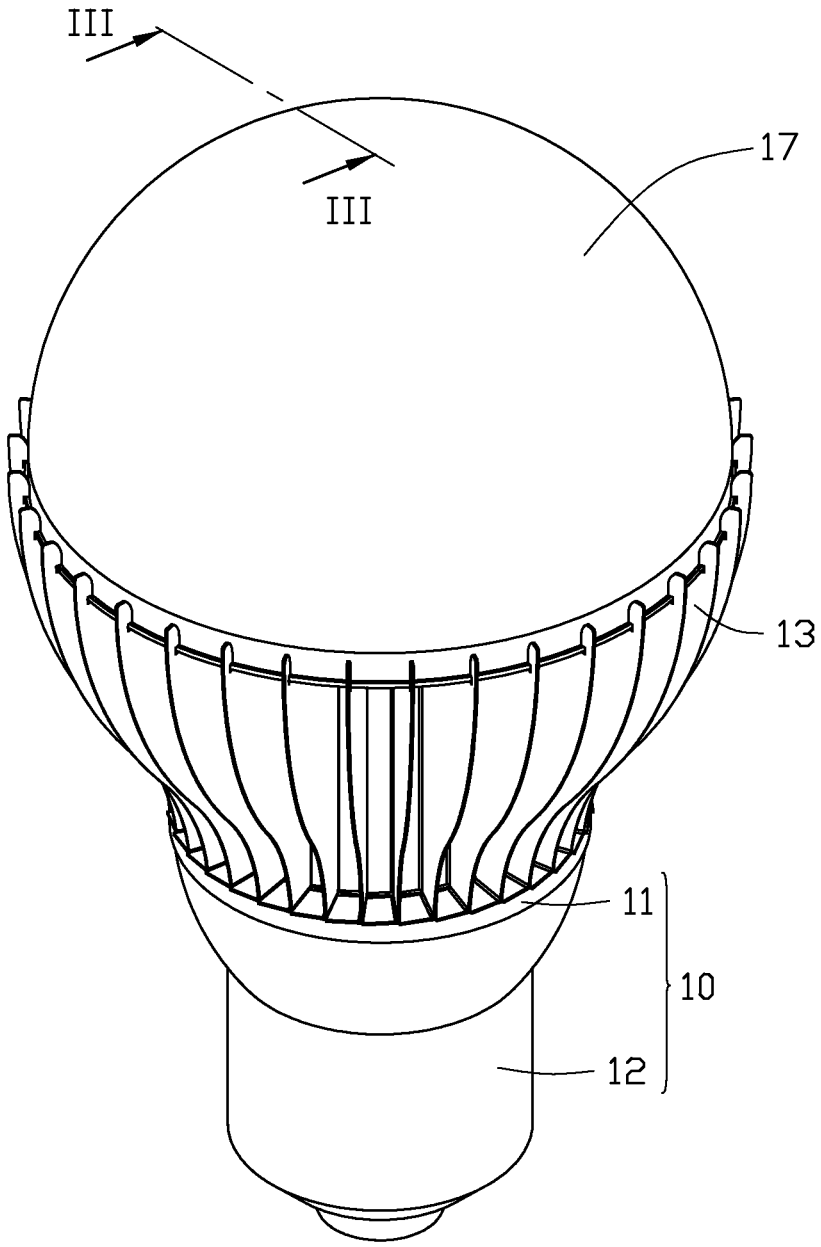
FIG. 1 is an isometric, assembled view of a lamp in accordance with an exemplary embodiment of the present disclosure.
Figure 2:
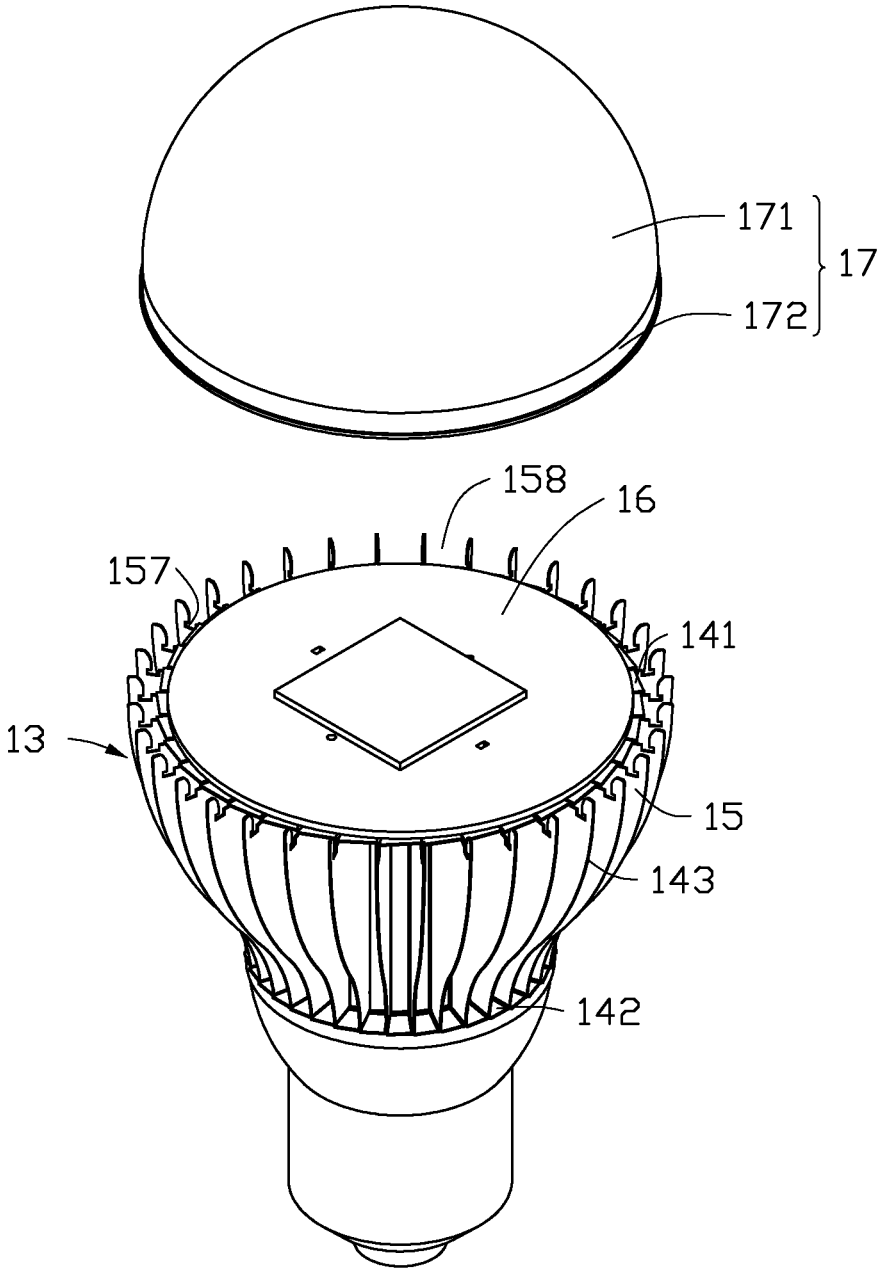
FIG. 2 is an isometric, exploded view of the lamp in FIG. 1.
Figure 3:
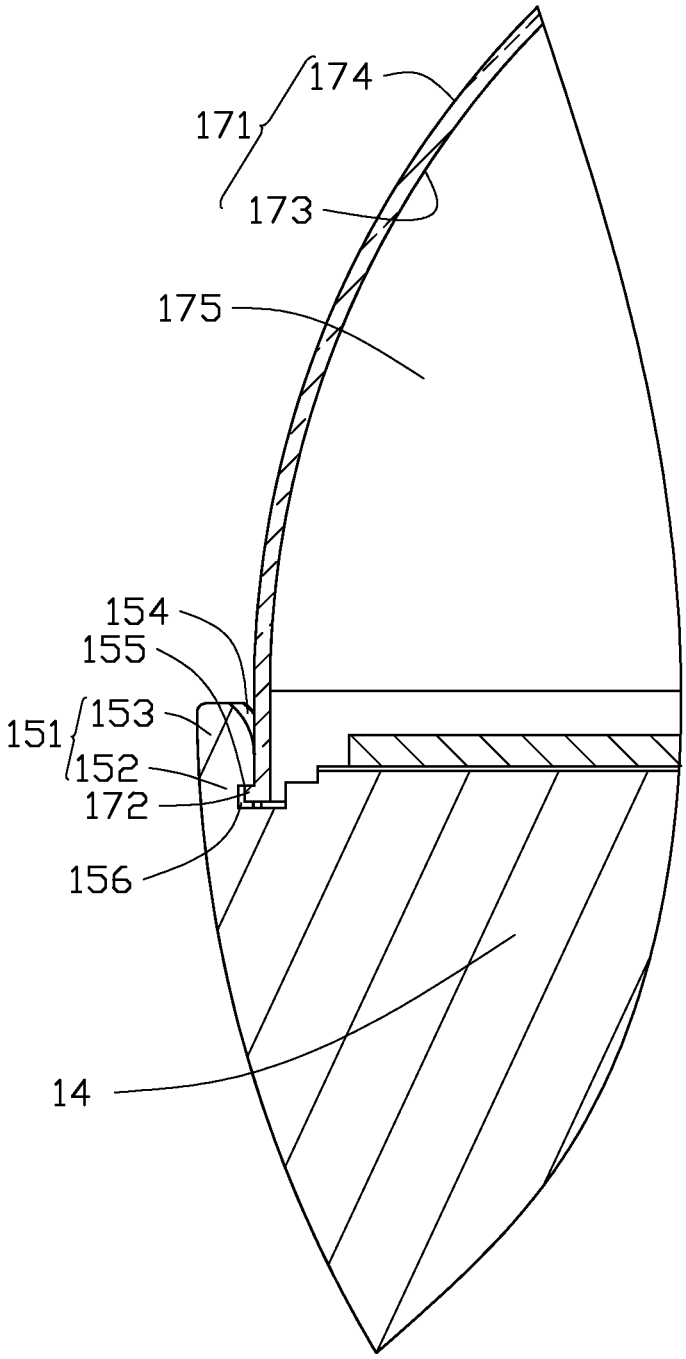
FIG. 3 is a partially cross-sectional view of the lamp in FIG. 1, along line III-III thereof.

As shown in FIGS. 1-3, a lamp in accordance with an embodiment of the present disclosure includes a lamp holder 10, a heat sink 13 connected with the lamp holder 10, a light source 16 mounted on the heat sink 13, and a lamp cover 17 mounted on the heat sink 13 and covering the light source 16.

The lamp holder 10 includes a securing portion 11 and an electrical connector 12. The electrical connector 12 is secured to one end (i.e., bottom end) of the securing portion 11, and is configured for connecting a power source (not shown) which can supply an electric power to the lamp. The other end (i.e., top end) of the securing portion 11 securely connects with the heat sink 13. The electrical connector 12 can be directly inserted into a standard socket for a conventional incandescent bulb or fluorescent lamp which is electrically connected with the power source, such that the lamp in accordance with the present disclosure can replace the conventional incandescent bulb or compact fluorescent lamp.

The heat sink 13 is mounted on and engaged with the securing portion 11 of the lamp holder 10. The heat sink 13 includes a main body 14 and a plurality of fins 15. The main body 14 is substantially post-shaped, and includes a planar first surface 141, a planar second surface 142 and a cylindrical side surface 143. The first surface 141 faces away from the lamp holder 10 and the second surface 142 is opposite to the first surface 141. The side surface 143 is connected between the first surface 141 and the second surface 142. The plurality of fins 15 each extends radially and outwardly from the side surface 143 of the main body 14 and surround circumferentially the main body 14.

The heat sink 13 forms a plurality of clamping portions 151 at a top side thereof. The plurality of clamping portions 151 is circumferentially positioned around the first surface 141. The clamping portions 151 are equidistantly spaced from each other along a circumferential direction of the heat sink 13, and two diametrically opposite clamping portions 151 are symmetrical to each other in respect to an axis of the lamp. The clamping portions 151 cooperatively define an opening 158 at the top side of the heat sink 13. The plurality of clamping portions 151 each defines a recess 156 in a bottom of an inner side thereof, wherein the recess 156 faces a center of the heat sink 13. Each of the clamping portions 151 extends from a top side of the fin 15. The clamping portion 151 includes a supporting arm 152 and a hook 153. The supporting arm 152 extends upwardly from the top side of the fin 15, and the hook 153 extends radially and inwardly from a free end of the supporting arm 152. The hook 153 includes a tapered guiding surface 154 and a securing surface 155. The guiding surface 154 is located at an inner side of the hook 153, and faces the center of the heat sink 13. The securing surface 155 is located at a bottom side of the hook 153 and faces the first surface 141 of the main body 14 of the heat sink 13 and the recess 156. The securing surface 155 is spaced apart from the first surface 141 of the main body 14, wherein the recess 156 is defined between the first surface 141 of the main body 14 and the securing surface 155. Two adjacent recesses 156 communicate with each other along the circumferential direction of the heat sink 13, whereby an annular engaging groove 157 is defined in the heat sink 13 along the circumferential direction of the heat sink 13.

The lamp cover 17 is made of transparent or translucent plastic. The lamp cover 17 is located on and connected with the heat sink 13; the lamp cover 17 and the heat sink 13 cooperatively define a receiving room 175 therebetween. In the illustrated embodiment, the first surface 141 of the main body 14 faces the lamp cover 17 whereby the first surface 141 of the main body 14 and the lamp cover 17 cooperatively define the receiving room 175.

The lamp cover 17 is hollow hemisphere-shaped, and includes a covering portion 171 and a connecting portion 172. The covering portion 171 includes a light incident surface 173 and a light output surface 174. The light incident surface 173 is located at an inner side of the lamp cover 17 and faces the heat sink 13. The light output surface 174 is located at an outer side of the lamp cover 17 and opposite to the light incident surface 173. The connecting portion 172 has an annular shape and extends radially and outwardly from a bottom side of the covering portion 171.

The light source 16 is directly mounted on the first surface 141 of the main body 14 and received in the receiving room 175. The light source 16 faces the light incident surface 173 of the lamp cover 17. The engaging groove 157 surrounds the light source 16. In operation, light emitted by the light source 16 incidents on the light incident surface 173, and then travels out of the lamp cover 17 via the light output surface 174. In the illustrated embodiment, the light source 16 is a light emitting diode (LED) module.

In assembly, the lamp cover 17 is placed over the first face 141 of the main body 14 of the heat sink 13 with the connecting portion 172 of the lamp cover 17 aimed at the opening 158 of the heat sink 13. The lamp cover 17 is then pushed downwardly to cause the connecting portion 172 to move downwardly along the guiding surfaces 154 of the hooks 153 whereby the hooks 153 are outwardly pushed and the opening 158 of the heat sink 13 is enlarged. The tapered guiding surfaces 154 of the hooks 153 thus guide the connecting portion 172 to slide into the engaging groove 157 of the heat sink 13. Once the connecting portion 172 has entered the engaging groove 157, the hooks 153 elastically restore back to their original state. The securing surfaces 155 of the hooks 153 abut against the connecting portion 172 of the lamp cover 17. The clamping portions 151 of the heat sink 13 prevent the connecting portion 172 of the lamp cover 17 from escaping from the engaging groove 157. The connecting portion 172 of the lamp cover 17 is engaged in the engaging groove 157 and abuts a periphery portion of the first surface 141 of the main body 14 of the heat sink 13. The clamping portions 151 of the heat sink 13 surround the lamp cover 17 and fix the connecting portion 172 of the lamp cover 17 onto the top side of the heat sink 13. Therefore, the lamp cover 17 is easily and firmly fixed on the heat sink 13.

In the illustrated embodiment, the connecting portion 172 is formed on the lamp cover 17, and the plurality of clamping portions 151 is formed on the heat sink 13. Alternatively, the connecting portion 172 can be formed on the heat sink 13, and the plurality of clamping portions 151 can be formed on the lamp cover 17.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A lamp comprising:

a light source;

a heat sink; and a lamp cover mounted on the heat sink;

wherein the lamp cover comprises a connecting portion, the heat sink defines an annular engaging groove, and the connecting portion is engaged in the engaging groove to connect the lamp cover and the heat sink together;

wherein the heat sink comprises a main body, a plurality of fins circumferentially surrounding the main body, and a plurality of clamping portions extending from top sides of the plurality of fins respectively, the light source being mounted on the main body, the plurality of fins being spaced from each other along a circumferential direction of the heat sink, the plurality of clamping portions being equidistantly spaced from each other along the circumferential direction of the heat sink and surrounding the connecting portion of the lamp cover, each of the plurality of clamping portions defining a recess, all the recesses communicating with each other to cooperatively define the annular engaging groove.

2. The lamp of claim 1, wherein the recess faces the lamp cover.

3. The lamp of claim 2, wherein the clamping portions each comprise a supporting arm extending from a top side of the heat sink and a hook extending radially and inwardly from a free end of the supporting arm, the recess being defined in the hook.

4. The Lamp of claim 3, wherein the main body comprises a first surface, a second surface spaced apart from the first surface and a cylindrical side surface connected between the first surface and the second surface, the light source being mounted on the first surface of the main body, the fins extending radially and outwardly from the side surface of the main body.

5. The lamp of claim 4, wherein the hook comprises a tapered guiding surface and a securing surface, the tapered guiding surface located at an inner side of the hook and facing the lamp cover, the securing surface located at a bottom side of the hook and facing the first surface of the heat sink, the securing surface being spaced apart from the first surface of the main body with the recess being defined between the first surface of the main body and the securing surface.

6. The lamp of claim 1, wherein the lamp cover and the heat sink cooperatively define a receiving space for receiving the light source therein.

7. The lamp of claim 6, wherein the lamp cover comprises a light incident surface facing the light source and a light output surface opposite to the light incident surface.

8. The lamp of claim 1 further comprising a lamp holder connecting with the heat sink, the lamp holder being configured for electrically connecting with a power source for obtaining electrical power therefrom.

9. A lamp comprising:

a light source;

a heat sink; and a lamp cover mounted on the heat sink;

wherein the lamp cover comprises a connecting portion, the heat sink comprising a main body, a plurality of fins circumferentially surrounding the main body, and a plurality of clamping portions extending from top sides of the plurality of fins respectively, the light source being mounted on the main body, the plurality of fins being spaced from each other along a circumferential direction of the heat sink, the plurality of clamping portions surrounding the lamp cover and being spaced apart from each other along the circumferential direction of the heat sink, the plurality of clamping portions each defining a recess facing the lamp cover, all the recesses communicating with each other whereby an annular engaging groove is defined in the heat sink, the engaging groove surrounding the lamp cover, and the connecting portion being engaged in the engaging groove whereby the lamp cover is connected with the heat sink.

10. The lamp of claim 9, wherein the lamp cover and the heat sink cooperatively define a receiving space for receiving the light source therein.

11. The lamp of claim 10 further comprising a lamp holder connecting with the heat sink, the lamp holder being configured for electrically connecting with a power source for obtaining electrical power therefrom.

12. The lamp of claim 11, wherein the plurality of clamping portions each comprises a supporting arm and a hook, the supporting arm extending from a top side of the heat sink, the hook extending radially and inwardly from a free end of the supporting arm, the hook being spaced apart from the top side of the heat sink whereby the recess is defined between the hook and the heat sink.

13. The lamp of claim 12, wherein the main body comprises a first surface, a second surface and a cylindrical side surface, the light source being mounted on the first surface, the first surface facing the lamp cover, the second surface being opposite to the first surface, the side surface connecting between the first surface and the second surface, the plurality of fins extending outwardly from the side surface, the plurality of fins each forming the clamping portion, the supporting arms extending from the fins, respectively.

14. The lamp of claim 13, wherein the hook comprises a tapered guiding surface and a securing surface, the tapered guiding surface being located at an inner side of the hook and facing the lamp cover, the securing surface being located at a bottom side of the hook and facing the first surface of the heat sink, the securing surface being spaced apart from the first surface of the main body wherein the recess is defined between the first surface of the main body and the securing surface.

* * * * *